US006957453B2

(12) United States Patent
Branch, III

(10) Patent No.: US 6,957,453 B2
(45) Date of Patent: Oct. 25, 2005

(54) WASHABLE HAMMOCK

(75) Inventor: Jesse A. Branch, III, Winterville, NC (US)

(73) Assignee: Hatteras Hammocks, Inc., Greenville, NC (US)

( * ) Notice: Subject to any disclaimer, the term of this patent is extended or adjusted under 35 U.S.C. 154(b) by 1 day.

(21) Appl. No.: 10/751,870

(22) Filed: Jan. 7, 2004

(65) Prior Publication Data

US 2005/0144719 A1 Jul. 7, 2005

(51) Int. Cl.[7] ..... A45F 3/22
(52) U.S. Cl. ..... 5/123; 5/122
(58) Field of Search ..... 5/120, 122, 123

(56) References Cited

U.S. PATENT DOCUMENTS 1,814,579 A * 7/1931 Ames ..... 5/122
1,917,518 A * 7/1933 Goudie ..... 5/120
2,062,069 A * 11/1936 Powers ..... 5/123
5,655,235 A * 8/1997 DeAth ..... 5/123

* cited by examiner

*Primary Examiner*—Frederick L. Lagman
(74) *Attorney, Agent, or Firm*—Gipple & Hale

(57) ABSTRACT

A washable hammock is described, having a spreader bar which can be readily removed, allowing the hammock to be laundered. The spreader bar can be reinserted after the hammock is laundered.

3 Claims, 4 Drawing Sheets

WASHABLE HAMMOCK

FIELD OF THE INVENTION

This invention is directed to the structure of a hammock, and specifically to a hammock with spreader bars that can be removed so the hammock can be laundered and then reinserted after the hammock is laundered.

BACKGROUND OF THE INVENTION

Hammocks are an increasingly popular way to relax in the outdoors amid sunshine and fresh air. Extended between trees or in a hammock stand, hammocks provide a useful and handsome addition to the backyard or patio. Hammocks are most commonly made of white rope or white canvas. The humans that occupy such hammocks are not always clean. Their clothes may be soiled and greasy; they may spill a beverage; the pets that often join them in the hammock may have muddy fur. For many reasons a hammock may become soiled and stained. When this happens the hammock, while still useful, is no longer such a handsome addition. It is unsightly and unsanitary.

The obvious solution is to launder the hammock, since the rope and/or fabric which make up the hammock are readily subject to laundering with soap, bleach, disinfectant, etc. The obstacle to such laundering of a hammock is that it includes spreader bars which are long and rigid (usually made of wood). There is a spreader bar on each end of the hammock between the hammock bed and the clew. It is the function of the spreader bar to keep the hammock bed in a laterally extended position. It cannot be eliminated, but the hammock cannot be laundered with the spreader bar in place.

It is, accordingly, an object of the present invention, to provide a hammock in which the spreader bars can effectively function while the hammock is in use, but can be easily removed when the hammock needs laundering.

DISCLOSURE OF THE PRIOR ART

Applicant is aware of no relevant prior art that directly relates to or anticipates this invention.

SUMMARY OF THE INVENTION

In accordance with the present invention, a hammock is provided which can be laundered. The hammock is of a standard variety having a hammock bed with spreader bars at each end and clew ropes extending from each spreader bar to clew rings which can be attached to support hooks on adjacent trees, a hammock stand or other support structure.

In the standard hammock, the clew ropes pass through a series of holes in the spreader bar, which keep the clew ropes spread apart at regular intervals. But in the present invention the spreader bars are encased in a fabric sheath. The sheath has eyelets along its periphery. The clew ropes pass through the eyelets and under but not through the spreader bar. The eyelets function like the holes in a standard spreader bar, to keep the clew ropes spread apart at regular intervals.

The fabric sheath is closed at one end; the other end has a pull-over pocket that folds into itself, thus closing that end while the hammock is in normal use. But when laundering is required, the pull-over pocket end can be inverted thus opening up that end of the sheath and the spreader bar can be drawn out of the sheath. After laundering the hammock, the spreader bars are reinserted into the sheaths and the pull-over pocket ends folded over to again close that end.

DETAILED DESCRIPTION OF THE DRAWINGS

Reference will now be made in detail to the present preferred embodiment of the invention illustrated in the accompanying drawings.

Figure 1:
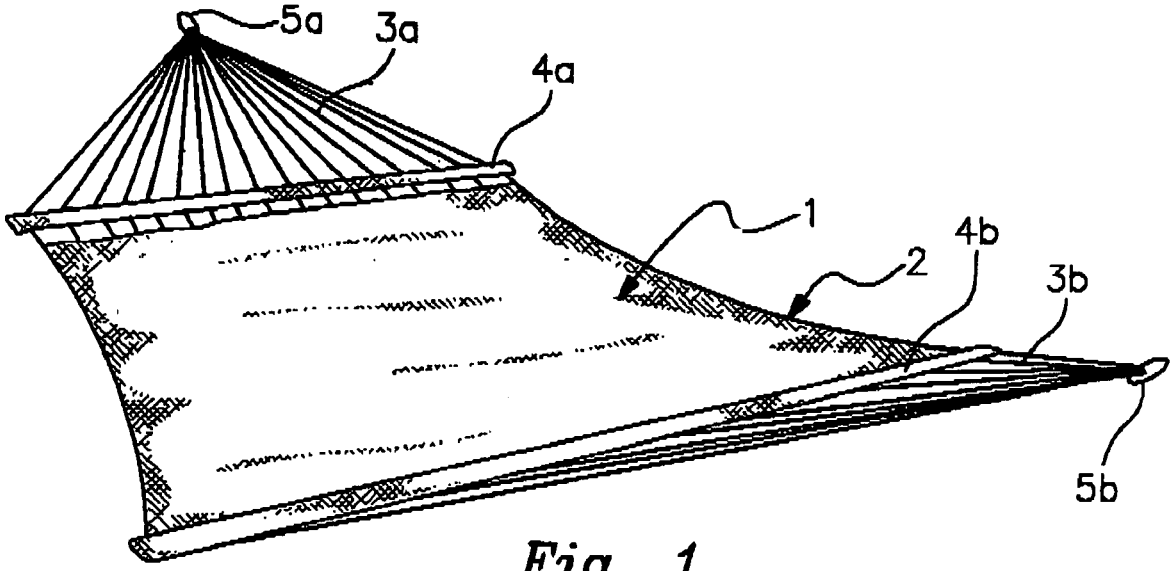
FIG. 1 is a perspective view illustrating a hammock of the invention.

As illustrated in FIG. 1, a hammock 1 is comprised of hammock bed 2, which extends between spreader bars 4*a* and 4*b*. Clews 3*a* and 3*b* extend from spreader bars 4*a* and 4*b* and terminate in metal clew rings 5*a* and 5*b*. The clew rings 5*a* and 5*b* can be attached to supporting hooks on trees or a hammock stand.

Figure 2:
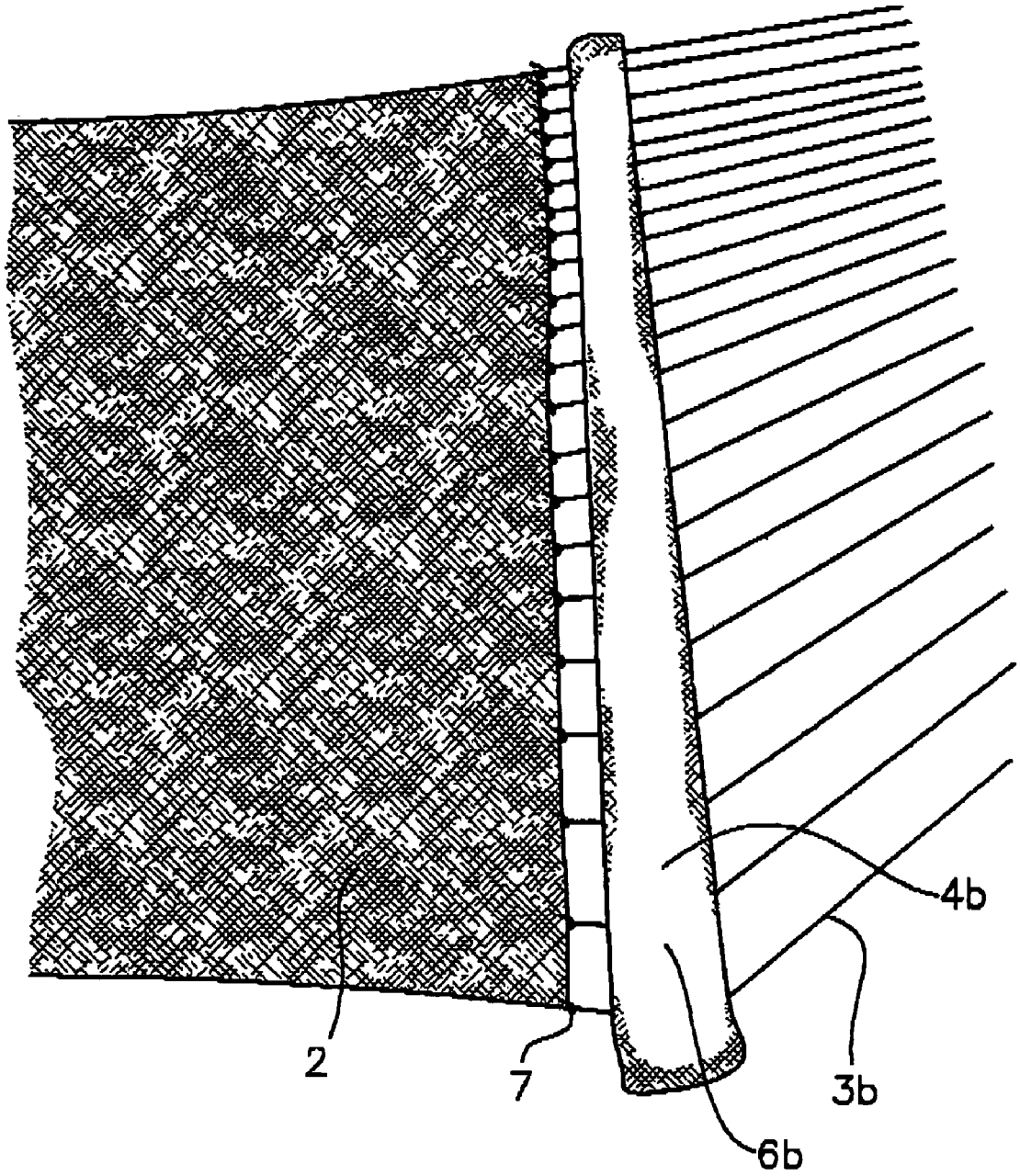
FIG. 2 is a perspective view illustrating the upper side of the hammock spreader bar.

From FIG. 2, it will be appreciated that the spreader bar 4*b* is enclosed within a fabric casement 6*b*.

Figure 3:
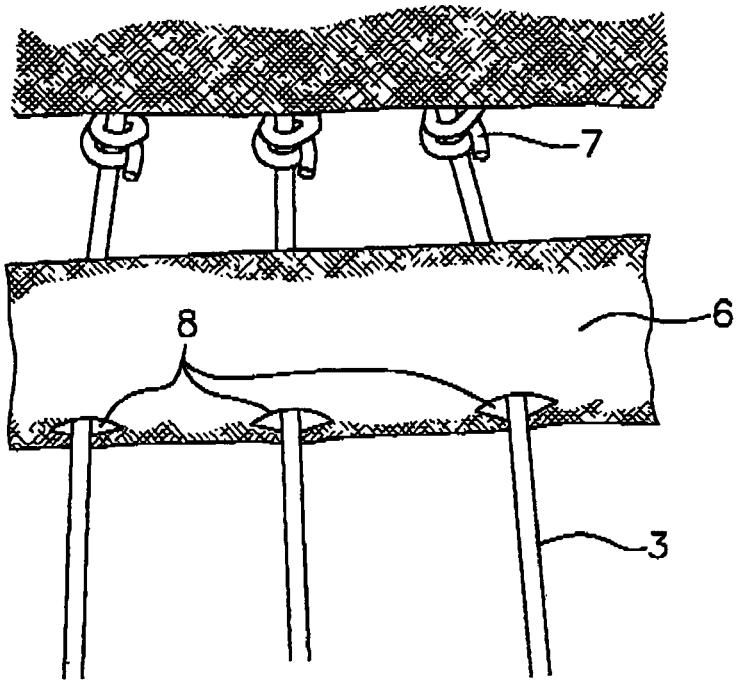
FIG. 3 is a perspective detail of the upper side of the spreader bar fabric casement.

FIG. 3 illustrates that the fabric casement 6 has a series of eyelets 8 that are positioned at equal intervals along its outer edges. The ropes of clew 3 pass through the eyelets 8, beneath the spreader bar 4 and are tied with ropes of hammock bed 2, to form knots 7. The knots 7 keep the spreader bar 4 from moving inwardly toward the hammock bed 2. The inclination of the ropes of clew 3 keep the spreader bar 4 from moving outwardly toward the clew ring 5. Thus, the position of the spreader bar 4 is stabilized and maintained.

The conventional spreader bar is penetrated by a series of holes, through which the clew ropes pass and, on the other side of which they are attached to the hammock bed. In applicants's invention, the spreader bar has no holes, which renders it stronger and more durable. Instead of holes in the spreader bar, applicant's invention has eyelets in the fabric casement (covering the spreader bar) which perform the same function as holes in the spreader bar.

Figure 4:
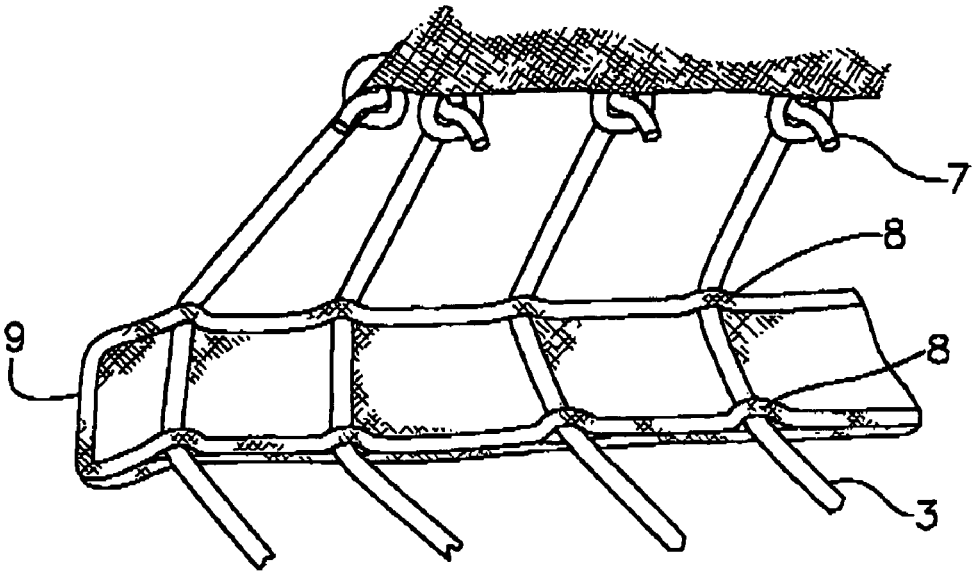
FIG. 4 is a perspective detail of the underside of the spreader bar fabric casement.
Figure 5:
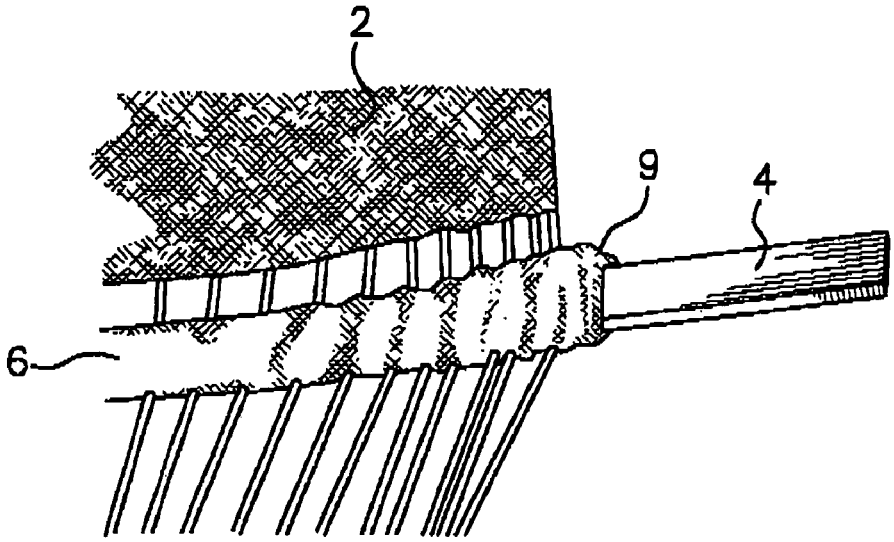
FIG. 5 is a perspective view of the spreader bar partially removed from the fabric casement.

From FIGS. 4 and 5, it is seen that the fabric casement 6, which is sewn shut on one end, has on the other end a pull-over flap 9. In normal use, the pull-over flap 9, keeps the spreader bar 4 from slipping out of the fabric casement 6 and maintains it in its functional position. But when laundering is needed, the pull over flap 9 can be opened and the spreader bar 4 thus removed, the remaining hammock can be put into a washing machine or otherwise laundered.

Figure 6:
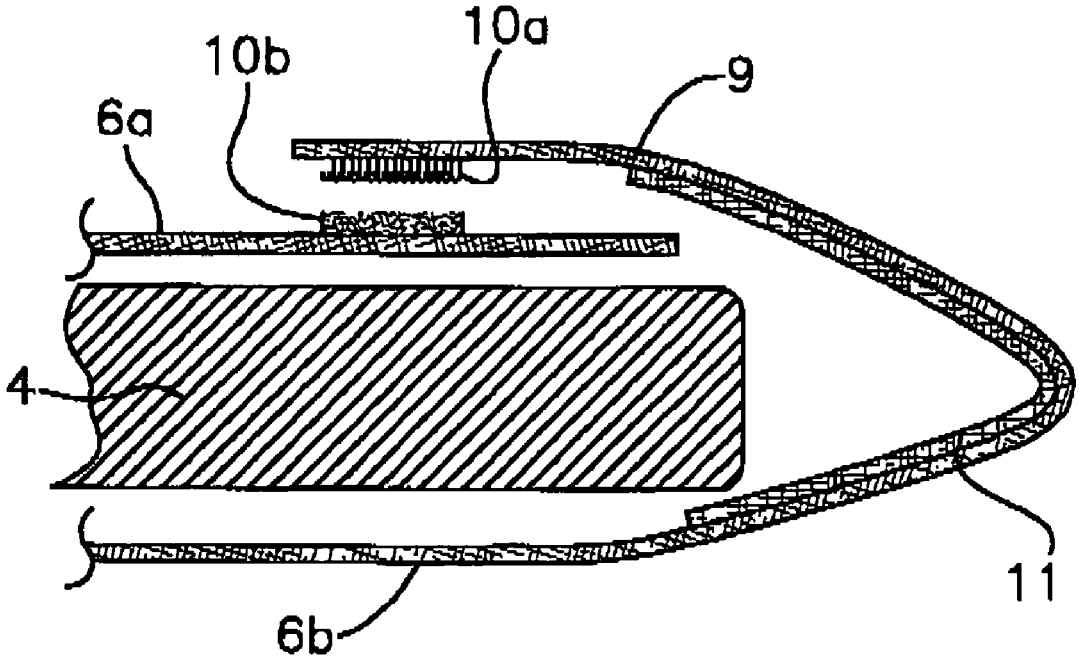
FIG. 6 is a cross sectional side view of end of the enclosed spreader bar and the pull over flap closure at end of the fabric casement.

The pull-over flap 9 is shown in greater detail in FIG. 6. The fabric casement 6 has an upper half 6*a* and a lower half 6*b*. The pull-over flap 9 is an extension of lower half 6*b* which folds over itself and extends over upper half 6*a*. The outer surface of upper half 6*a* has a strip of velcro 10*b*. The inner surface of flap 9 has a corresponding strip of velcro 10*a*. In normal use, the velcro strips 10*a* and 10*b* are engaged and the flap 9 secures the closure of that end of the fabric casement 6. But when it is desirable to remove the bar 4 from the casement 6, the velcro strip 10*a* can be pulled away from velcro strip 10*b*, and the flap 9 folded open to allow removal of the spreader bar 4.

Because the flap 9 is subject to occasional strong pressure of the spreader bar 4 moving laterally within fabric casement 6, the inner surface of flap 9 is reinforced with an additional strip of strong fabric 11.

What is claimed is:

1. A washable hammock comprising:

a hammock bed and hammock clew ropes formed of washable material;

a spreader bar at each end of said hammock bed serving to spread out the clew ropes;

means for attaching said clew ropes to said hammock bed;

a removable casement of washable material enclosing each spreader bar; and said removable easement including eyelets at regular intervals along its periphery, through which the said clew ropes pass, thus maintaining aid clew ropes at regular intervals corresponding to those eyelets;

said casement comprising a fabric sheath, closed on one end and on the other end having a pull-over pocket that can be inverted to open the sheath on that end.

2. The hammock of claim 1, wherein the clew ropes pass through said eyelets and under said spreader bar.

3. The hammock of claim 1, wherein said hammock bed and clew ropes are formed of washable rope.

* * * * *